US007649505B2

(12) United States Patent
Schadler

(10) Patent No.: US 7,649,505 B2
(45) Date of Patent: Jan. 19, 2010

(54) CIRCULARLY POLARIZED LOW WIND LOAD OMNIDIRECTIONAL ANTENNA APPARATUS AND METHOD

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 361 days.

(21) Appl. No.: 11/826,100

(22) Filed: Jul. 12, 2007

(65) Prior Publication Data

US 2008/0036683 A1 Feb. 14, 2008

Related U.S. Application Data

(60) Provisional application No. 60/836,397, filed on Aug. 9, 2006.

(51) Int. Cl.
*H01Q 1/12* (2006.01)

(52) U.S. Cl. ..... 343/890; 343/878; 343/891

(58) Field of Classification Search ..... 343/878, 343/890, 891, 892
See application file for complete search history.

(56) References Cited

U.S. PATENT DOCUMENTS 2,521,550 A * 9/1950 Smith ..... 343/742
3,553,701 A * 1/1971 Thomas ..... 343/766
4,799,067 A * 1/1989 Tekip et al. ..... 343/890
5,872,547 A * 2/1999 Martek ..... 343/815
6,441,796 B1 8/2002 Schadler
2002/0135531 A1 * 9/2002 Ehrenberg et al. ..... 343/878

OTHER PUBLICATIONS

Richard C. Johnson, ed., "Circularly Polarized Antennas", Antenna Engineering Handbook, Third Edition, 1993, Section 28-3, McGraw-Hill, Inc.

* cited by examiner

*Primary Examiner*—Tho G Phan
(74) *Attorney, Agent, or Firm*—Baker & Hostetler LLP

(57) ABSTRACT

A circularly polarized, omnidirectional, corporate-feed pylon antenna uses multiple helically-oriented dipoles in each bay, and includes a vertical and diagonal support arrangement of simple structural shapes configured to provide a frame strong enough to sustain mechanical top loads applied externally. The radiators in each bay fit within the vertical supports. The radiators are integrally formed with cross-braces, and are fed with manifold feed straps incorporating tuning paddles. A single cylindrical radome surrounds the radiative parts and the vertical supports. The antenna admits of application to the upper L-band at the full FCC-allowed ERP. Beam tilt, null fill, and vertical null can be readily accommodated.

23 Claims, 4 Drawing Sheets

CIRCULARLY POLARIZED LOW WIND LOAD OMNIDIRECTIONAL ANTENNA APPARATUS AND METHOD

CLAIM OF PRIORITY

This application claims priority to U.S. Provisional Patent Application titled, "Circularly Polarized Omnidirectional Low Wind Load Antenna Apparatus and Method", filed Aug. 9, 2006, having Ser. No. 60/836,397, which is hereby incorporated by reference in its entirety.

FIELD OF THE INVENTION

The present invention relates generally to radiating systems. More particularly, the present invention relates to single-feed circularly polarized omnidirectional broadcast antennas.

BACKGROUND OF THE INVENTION

The auction of the 700 MHz spectrum by the Federal Communications Commission (FCC) resulted in part from the shift of television broadcasting from analog to digital service. Some of the new license holders have begun rollout of a Digital Video Broadcast to Handheld (DVB-H) mobile television (TV) entertainment service. Since receivers for this service may be expected to be integrated into cell phones and similar devices, circularly polarized broadcast signals will likely be preferred.

By providing a signal with horizontal and vertical components of comparable strength, circular polarization offers independence between receiving antenna orientation and reception, at least within a plane perpendicular to a line of propagation between the transmitting and receiving antennas. That is, a simple (linearly polarized) receive dipole is capable of receiving, and is substantially insensitive in orientation with respect to, a circularly-polarized broadcast signal. By contrast, with a vertically (linearly) polarized transmitted signal, the same receive dipole receives very little signal if placed horizontally, and likewise for a horizontally polarized signal and a vertically oriented receive dipole. This can be a significant consideration in ensuring robust and stable received-image quality in a mobile handheld imaging device, for example. Multipath issues, such as reflections from buildings that can reverse polarization handedness and delay time-critical signals, are often managed through signal processing.

Omnidirectionality is frequently a desirable attribute of broadcast antennas, particularly in view of long-established FCC preference for azimuth uniformity in consumer-oriented broadcasting. A fundamental omni radiator, well understood in the art, is a vertical dipole (or a ground-plane-mirrored monopole), that cannot provide circular polarization and is limited regarding power, gain, beam tilt, and null fill. Some previous omni designs, such as that disclosed in U.S. Pat. No. 6,441,796 ('796), issued Aug. 27, 2002, incorporated herein by reference, can provide circular polarization.

In antennas according to the '796 patent, a plurality of omni radiators (bays) are configured in a vertical array. Each radiator in the '796 patent includes two or four arcuate, rod-section dipoles lying on quasi-helical paths around a vertical axis of the antenna common to all bays. As used herein, the term "quasi-helical" describes a radiator formed from material having a suitable shape, such as a cylindrical rod, effectively wrapped into a planar arcuate shape, then rotated without further forming to an orientation approximating a helical path. A projection into a plane perpendicular to the vertical axis of the antenna of a quasi-helical radiator is elliptical; a true helical radiator has a circular projection into that plane. A rod formed into true helical form also does not lie in any plane. The effect of using a quasi-helical radiator is to broaden the impedance bandwidth of the antenna compared to a true-helix equivalent.

The dipoles in the '796 patent are each driven near one end of one monopole, with the centermost ends of the monopoles (the midpoints of the dipoles) grounded to conductive radial structural components. A central hub of each bay is mounted to a strut; the struts project laterally with selected vertical spacing from a vertical bearing structure. Such a configuration is readily applied to a side-mounted antenna on a tower, for example.

The radiative parts of antennas according to the '796 patent emit a signal having a specific circular polarization in accordance with their arrangement—for example, a mirror-image arrangement (opposite direction of advance of the helical paths of the dipoles) would produce opposite circular polarization.

In many other previous omnidirectional antenna designs, individual circularly-polarized radiators are strongly directional. For a multiple-bay antenna using directional radiators to broadcast with a reasonable approximation of azimuth uniformity, three or more separate radiators in each bay are needed, pointing radially outward around a vertical axis. The radiators can be mounted around a central member for top mounting, i.e., mounting of the antenna at the top of a structure. Antennas including such elements require more radiating devices and more power distribution devices than do intrinsically omnidirectional radiators.

In addition to circular polarization, increasing transmitter power output to 5 KW is planned under the new bandwidth assignments in order to achieve effective radiated power (ERP) that approaches the FCC-permitted maximum. This power level is high compared to that of S-band transmitting systems currently used for purposes similar to those for which the auctioned upper-L band spectrum is intended. The new requirements also call for an economical antenna solution and a compact equipment package, both highly desirable attributes for implementation of a nationwide infrastructure. Small size in combination with a simple physical arrangement may result in low wind loading. Other considerations include capability to use a single product over the entire new spectrum without alteration, or to combine multiple signal channels on a single antenna.

SUMMARY OF THE INVENTION

The foregoing considerations are addressed, to a great extent, by the present invention, wherein in one aspect a circularly polarized, corporate-feed antenna is provided that, in some embodiments, affords simplicity in mechanical construction, higher power capability, high gain, broad bandwidth, improved omnidirectionality, accommodation to vertical null, beam tilt, and null fill, and suitability for inconspicuous mounting. The present invention provides a low cost, broadband, high power, low wind load, circularly polarized omnidirectional pylon antenna.

In one embodiment, a broadcast antenna is presented. The antenna includes a structural support base, a support structure that includes a plurality of substantially vertical struts, uniformly distributed about a central vertical axis of the antenna, wherein each of the vertical struts extends upward from a point of attachment to the base, and a first substantially horizontal cross-brace that interconnects the vertical struts at a first elevation above the support base. The antenna further includes a first single-feed radiator, substantially omnidirectional with respect to azimuth, that radiates an elliptically polarized signal, wherein the first radiator is structurally integral with the first cross-brace, and resides physically within a prismatic volume that encloses the horizontal extent of the support structure.

The first radiator includes at least a first conductive rod, joined to the first cross-brace proximal to a midpoint of a longest dimension of the rod, wherein the rod is on the order of a half-wavelength in physical length and substantially arcuate in form, and wherein the arc of the first rod falls along a quasi-helical path at a substantially constant distance from the central vertical axis of the antenna. The first radiator may also include a second conductive rod, substantially identical to the first conductive rod, wherein the first two rods are oriented with twofold rotational symmetry about the central vertical axis of the antenna.

The first radiator may further include a second two arcuate, quasi-helically-disposed conductive rods, substantially identical to one another, wherein the second two rods are oriented with rotational symmetry about the central vertical axis of the antenna and are interstitially positioned with respect to the first two rods, wherein the length, angle of advance, and distance from the vertical axis of the antenna of the second two rods are independent of the corresponding dimensions of the first two rods. The antenna may further include a central hub wherefrom a plurality of structural parts, that the first cross-brace includes, extend to attachment points with the plurality of vertical struts, a central coaxial connector that includes an outer conductor joined to the hub and an inner conductor passing therethrough and terminating at a flange distal to the connection loci of the connector, and a manifold feed strap connecting the flange to at least the first rod. The central hub, the structural parts that the cross-brace includes, and the rods of the first radiator may be formed into a single conductive unit by a forming process, wherein the forming process includes casting, molding, forging, metal joining, solid freeform fabrication, pressing, machining, a combination of these processes, or another process.

In another embodiment, a broadcast antenna is presented. The antenna includes antenna supports configured from a base position, capable of sustaining vertically-applied compression and tension loads and laterally applied bending, torque, and shear loads, originating at a plurality of locations uniformly distributed around a central vertical axis of the antenna, spacing apparatus for maintaining substantially constant spacing between the distributed load supports, one or more quasi-helically oriented dipole radiators for radiating a broadcast signal having elliptical polarization substantially invariant with azimuth from a location congruent with the spacing apparatus, and a radome for substantially barring air flow, water penetration, and access by airborne particulate matter from the interior volume containing the supports, spacing apparatus and the one or more radiators of quasi-helical form and orientation.

In still another embodiment, a method for broadcasting electromagnetic signals is presented. The method includes accepting at least one broadcast-level signal having a bandwidth extent and a power level that fall within a prescribed range, dividing the accepted signal into a plurality of individual signals, wherein the respective individual signals have spectrum characteristics substantially identical to the accepted signal, and wherein the respective individual signals have substantially identical phase and signal strength, and applying the respective individual signals to a plurality of broadband radiative devices that each radiate with elliptical polarization and substantial azimuthal omnidirectionality.

The respective radiative devices are integral with cross-bracing structures. Each of the respective radiative devices includes a plurality of quasi-helically-disposed, conductive, arcuate rods operable to radiate in a common frequency band, arranged with approximate n-fold rotational symmetry, where n is the number of rods included in a radiative device, the respective rods are joined to the cross-bracing structures at respective rod midpoints, and the signals applied to the respective radiative devices are so coupled to the respective rods as to radiate therefrom with substantially uniform phase. The method further includes providing vertical load bearing capability, from a locus above the topmost radiative device to a locus below the bottommost radiative device, sufficient to support not less than the full weight of and climatic loading applied to the structure. The method further includes providing junction between the cross-bracing structures and the load bearing capability, wherein mechanical interaction therebetween is sufficient to reduce tendencies for the load bearing capability to deform under load, and providing weather shielding, wherein a weather protective enclosure includes at least a tubular sleeve of substantially continuous, cylindrical, nonconductive material, external to the load bearing and radiative components.

There have thus been outlined, rather broadly, features of the invention, in order that the detailed description thereof that follows may be better understood, and in order that the present contribution to the art may be better appreciated. There are, of course, additional features of the invention that will be described below and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention is shown in the figures, wherein like numerals refer to like elements throughout. Earlier designs for circularly polarized, high-gain, omnidirectional antennas for high L-band generally have high wind loading, weight, and complexity, and are generally not designed for ordinary broadcast applications. The present invention overcomes these disadvantages at least in part, having instead the characteristics described below.

Regarding bandwidth issues, S-band development provides an instructive archetype for antennas according to the present invention. S-band begins at 1.5 GHz, immediately above L-band; the present invention addresses primarily the latter band, previously unavailable for this type of use. Typical S-band antennas have very narrow bandwidth. The present invention provides antennas with an impedance and pattern bandwidth capable of covering the entire lower 700 MHz band (698 to 746 MHz, former television channels 52 through 59, near the upper end of L-band). This capability is realized by arranging broadband circularly polarized radiating elements in a multiple-bay, single-axis vertical array.

Figure 1:
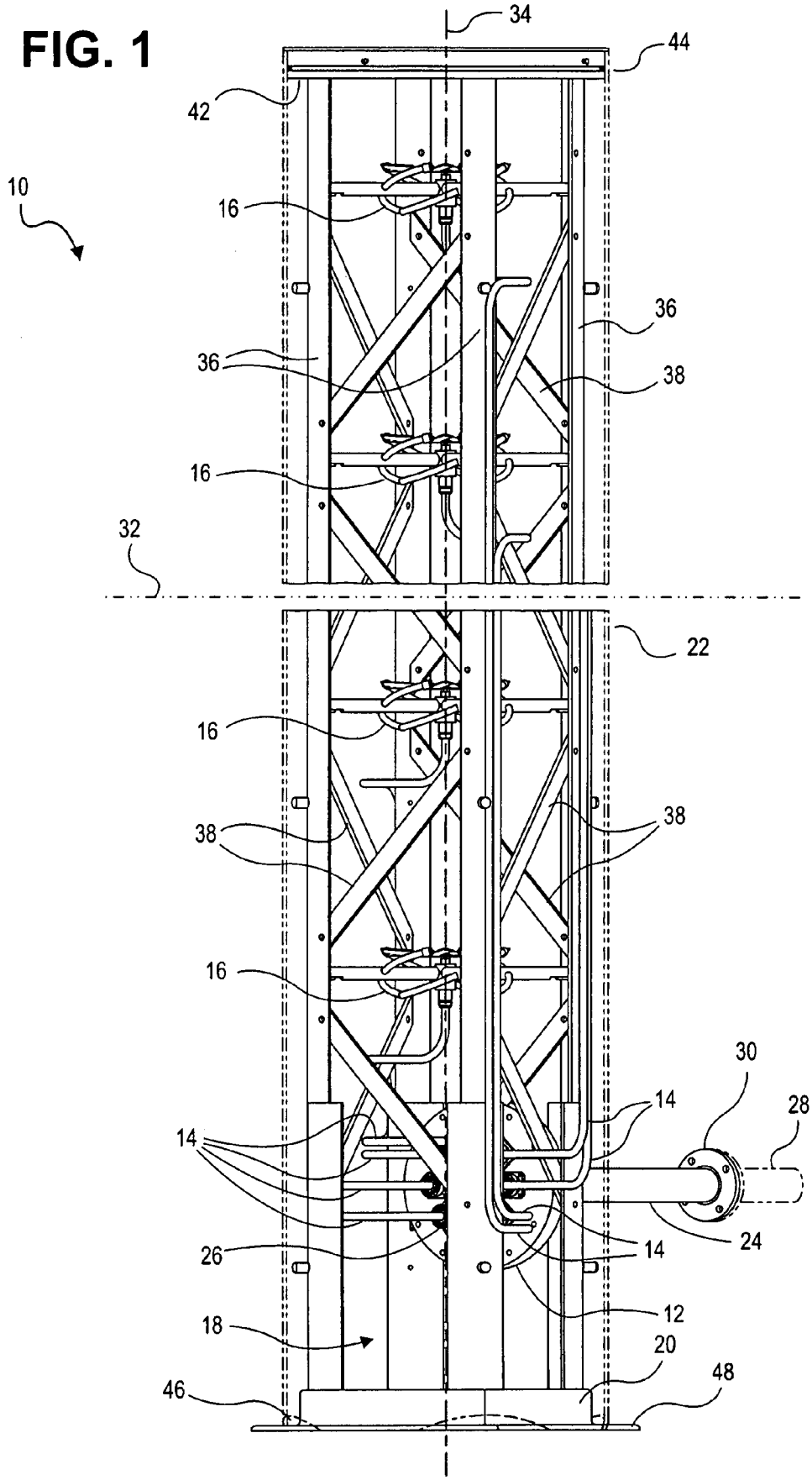
FIG. 1 is a perspective view of a complete antenna according to the present invention.

Regarding issues of high power, FIG. 1 shows an embodiment of an antenna 10 according to the present invention, including a dedicated power divider 12 driving a set of semi-rigid coaxial signal distribution lines 14 to deliver broadcast energy to a plurality of individual radiators 16, an arrangement that allows for high power capability. Each of the distribution lines 14 is a helically-corrugated coaxial transmission line in the embodiment shown. For graphical simplicity, the helical corrugations are omitted from the drawing, but may be preferred in order to permit ease of manufacture while assuring low impedance error, since the outer-conductor construction and dielectric material in such lines assure low flattening (cross-section distortion) during such manufacturing steps as coiling and stowing surplus line in a reserve area 18 at the antenna base 20.

Regarding wind loading, a simple, cylindrical radome envelope 22, shown in phantom in FIG. 1, and preferably scaled specifically for the lower 700 MHz band, encloses the entire radiative assembly 10 in a single, low-drag, "pylon" shaped body. A simple cylinder offers appreciably lower drag than more complex arrangements, such as multiple, independently enclosed, directional radiators of comparable total cross-sectional area, with an improvement on the order of 40% in some embodiments.

Despite low material cost and simplicity, the present invention may be configured with increased mechanical strength compared to that required merely to allow the antenna to be self-supporting. This strength extends even to the extent of supporting a high dynamic load, such as that applied by a flagpole, above the radiating portion of the antenna 10.

The power divider 12 shown in FIG. 1 distributes applied signal power to the individual circularly polarized radiators 16. The power divider 12 accepts a broadcast signal from a single coaxial input port 24, and provides multiple outputs at coaxial ports 26, which outputs may be uniform in phase and power level. The power divider 12, like the radiators 16 discussed in greater detail below, may have a broad passband in some embodiments, and can exhibit low dissipative (heat) loss in keeping with known methods for providing broadband, high-power RF signal dividers. Each of the power divider output ports 26 includes a pressure barrier (not shown) in accordance with known practice, so that the interior of the radome 22 is not pressurized in the embodiment shown. Configuring the radome 22 as nonpressurized should not be viewed as limiting. Signal output power level to each port 26 may be unequal in some embodiments, for such purposes as tailoring beam characteristics.

A flanged, pressurized feed line 28 (the portion connecting to the antenna input is shown in phantom in FIG. 1) connects to the flange 30 of the input port 24 of the power divider 12 in the embodiment shown. Although flanged connections and pressurization are shown and described, other mechanism may also be used.

The distribution lines 14 are coaxial lines that carry power from the power divider 12 to the radiators 16. The distribution lines 14 in the embodiment shown are equal in length, with excess coaxial line length coiled in the reserve area 18 below a bottommost radiator 16 so that radiators 16 successively farther from the power divider 12 are nonetheless fed by lines 14 of equal length. In other embodiments, the distribution lines 14 may vary in length, such as with each higher radiator 16 fed by a longer feed line 14. Such arrangements tend to degrade antenna bandwidth to a greater or lesser extent, but may be preferred in some embodiments, for purposes such as cost and/or weight reduction.

Small adjustments in the relative lengths of the individual distribution lines 14 allow beam tilt and/or null fill to be provided. The individual radiators 16 generate circularly polarized signals independently of one another, and are fed with delay that depends in large part on the lengths of the respective distribution lines 14 and the properties of the power divider 12. As a consequence, it is possible to drive the respective radiators 16 simultaneously, generating a main beam that has no deliberate tilt. This means that the far-field signal in a plane 32 passing through the middle of the antenna 10 aperture (the extent from the top radiator to the bottom radiator), and perpendicular to a central vertical axis 34 of the antenna, is most strongly reinforced. According to this description, the signal strength at angles above or below the perpendicular plane 32 is reduced in proportion to the deviation of the angle from zero degrees, so that a primary beam in the shape of a flattened toroid is formed. The gain of the beam (flatness of the toroid) is a function of, among other factors, the aperture size, the number of radiators, and the vertical spacing between radiators.

It is further possible to alter the lengths of the respective distribution lines 14 in such a way as to cause far-field signals to be most reinforced at an angle other than zero degrees—that is, to introduce beam tilt. Similarly, a pronounced null immediately below the main beam may degrade close-in reception. To offset this, it may be helpful to deviate the lengths of the distribution lines 14, such as by altering one or more lines to an extent different from that required by beam tilt. This can broaden the main beam to improve close-in reception, while decreasing peak beam strength (and range) only slightly, a process termed null fill.

Vertical placement of the radiators 16 can be used to establish beam shape, but is not used in the embodiment shown to effect beam tilt or null fill. The term "antenna aperture" as used herein relates to the effective extent from the highest to the lowest point of the radiative parts of the antenna. Aperture in general determines gain, referenced to a point source radiator (0 dB) or a dipole (+2 dB) in free space. The number of radiators within the aperture establishes a limit on emitted power capacity, and, in conjunction with gain, height above average terrain, and details of radiator design, determines effective broadcasting range of a signal with a given power level.

It is desirable in many applications (including for safety in low-mounted systems) to have an emission pattern that includes a null directly below the antenna. As is readily derived, a highly effective vertical spacing for providing both a vertical null and high gain in proportion to the number of radiators uses a spacing between radiators that is slightly less than one wavelength, namely $(n-1)/n$ wavelengths, where n is the number of radiators. For example, for a single radiator, there is no spacing; for two, they are approximately one-half wavelength apart, for eight, they are approximately ⅞ of a wavelength apart, and so forth. If i is an integer less than n, all values of (n−i)/n produce such a null except i=0. For negative values of i (spacings greater than one wavelength), there is a tendency to produce banding, and for positive values of i greater than 1, the aperture decreases, so that gain as a function of signal power is sacrificed. Unless an embodiment is vertically constrained, therefore, the preferred spacing between radiators remains (n−1)/n wavelengths for many antennas according to the invention herein disclosed.

Figure 4:
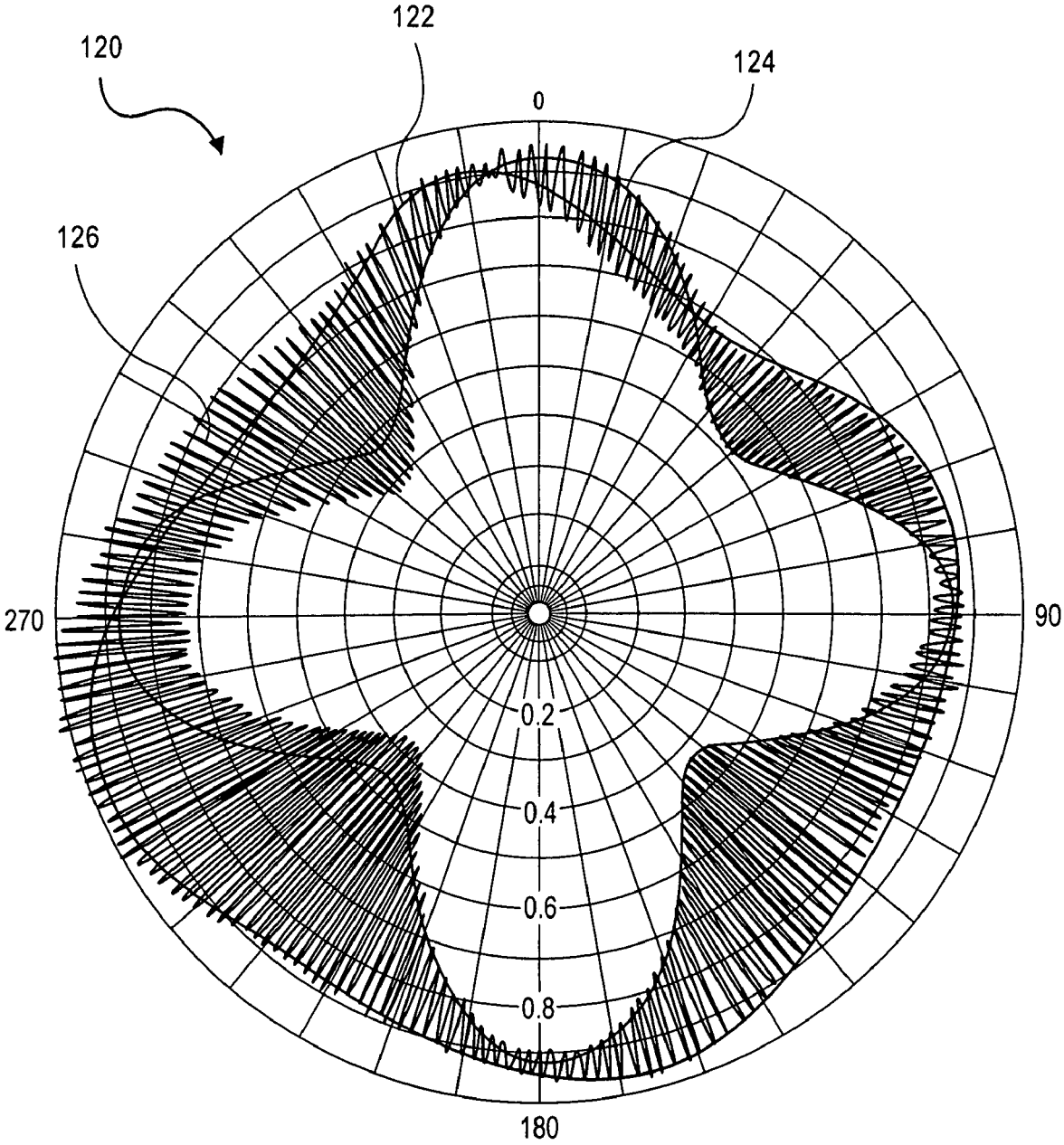
FIG. 4 is a measured pattern showing signal strength versus azimuth for a steel-framed prototype antenna according to the present invention.

Since the outer conductors of the respective distribution lines 14 are at roughly the same (ground) potential as the main input 24 outer conductor, the distribution lines 14 act as vertically oriented parasitics—known in the art as directors—that are long compared to a wavelength. Like the vertical struts 36, these may have negligible effect on the horizontally polarized component of antenna output versus azimuth, while causing the vertically-polarized component to exhibit gain variation. A graphical representation 120 of this phenomenon as shown in FIG. 4, and as discussed in greater detail below, is described in the art as a "propeller" shape; the effect in the embodiment shown can be calculated and measured to be on the order of 3 dB. In the presence of conductive vertical struts 36, also discussed below, the distribution lines 14 may not be appreciable contributors to signal propagation characteristics.

Note that the distribution lines 14 for the elements 16 in FIG. 1 rise in multiple groups at multiple azimuths. In some embodiments, the individual distribution lines 14 may rise at a common azimuth. The distribution lines 14 are shown with their vertical portions positioned near the outermost extent of the antenna 10. In this arrangement, each line or group of lines 14 subtends a relatively small arc of the radiating pattern, and is not significantly intrusive in the feed arrangement at each radiator 16. In some embodiments, it may be preferred to position the vertical portions of the distribution lines 14 nearer the central vertical axis 34 of the antenna 10.

Regarding tradeoffs between use of conductive and nonconductive support structure, the embodiment shown in FIG. 1, which uses four vertical support struts 36, has been tested at least in glass-fiber reinforced polymer (FRP, commonly referred to as fiberglass) and in steel. In embodiments wherein the vertical struts 36 of the support structure are metallic, such as aluminum or steel of suitable dimensions, high strength can be achieved at low material cost. In embodiments wherein the vertical struts 36 are a dielectric material, such as FRP, weight can be lowered with minimal cost impact, but may result in reduced stiffness and/or load bearing capacity of the overall structure. In still other embodiments, higher performance materials such as carbon fiber, which has moderate conductivity, or other relatively exotic reinforcing fibers, such as aramid or blends of fibers, may be used as reinforcing filler for matrix-forming polymers such as epoxies, polytetrafluoroethylene (PTFE), high-density polyethylene (HDPE), or polyvinyl chloride (PVC), for blends, or for other matrix materials. Vertical struts 36 that are nonconductive and/or exhibit a low dissipation factor can reduce interaction between the structure and the radiated pattern in at least some embodiments.

Perimeter cross members—that is, structural elements that join the vertical struts 36 to one another without significantly intruding into a prismatic volume whereof the faces are defined by the extents of the vertical struts 36—are generally preferred to be nonconducting for embodiments wherein the diagonal cross members 38 and any horizontal cross members proximal to the faces of the vertical strut 36-defined volume (none are shown in FIG. 1) may potentially interact with the radiated signal. A material having properties generally comparable to FRP may be preferred in at least some embodiments. For example, FRP can be thermosetting, relatively low in cost, available off the shelf in familiar sizes and shapes based on standard steel construction shapes, and moderately easy to work with. FRP can also have acceptable electromagnetic properties, lifetime, strength-to-weight ratio, and stability over temperature. Other nonconductive materials, such as aramid reinforced polyester, filled thermoplastics, and the like, may be preferred in some embodiments. Conductive or semi-conductive materials may be less effective as cross members 38 to the extent that the materials absorb or reflect signals or exhibit electrolytic interaction with other parts of the antenna.

High mechanical strength in the vertical struts 36 can allow the antenna to serve an additional purpose, such as bearing another antenna, or a flagpole, weather vane, traffic monitoring camera, or the like. Such use, or the appearance of the antenna to be an anonymous gray cylindrical pylon, may allow the high-value device—the antenna and its associated transmitter—to be less conspicuous than, for example, an open framework bearing one or more cavity-backed directional radiators with their feed coaxes and specialized radomes.

In the embodiment shown, diagonal 38 elements of the support structure are nonconductive and low-loss, so that their interaction with the radiated signals—reflection, absorption, reradiation—is low. In embodiments having a high-strength support structure, the radome 22 may be thin or low in strength, required only to provide sun and/or ice protection, wind load management, and the like in a radio-transparent structure; in embodiments having a radome 22 with high strength and bearing negligible external load, the support structure may be made less robust to the extent that it is required to do little more than stabilize spatial placement of radiators 16.

Figure 2:
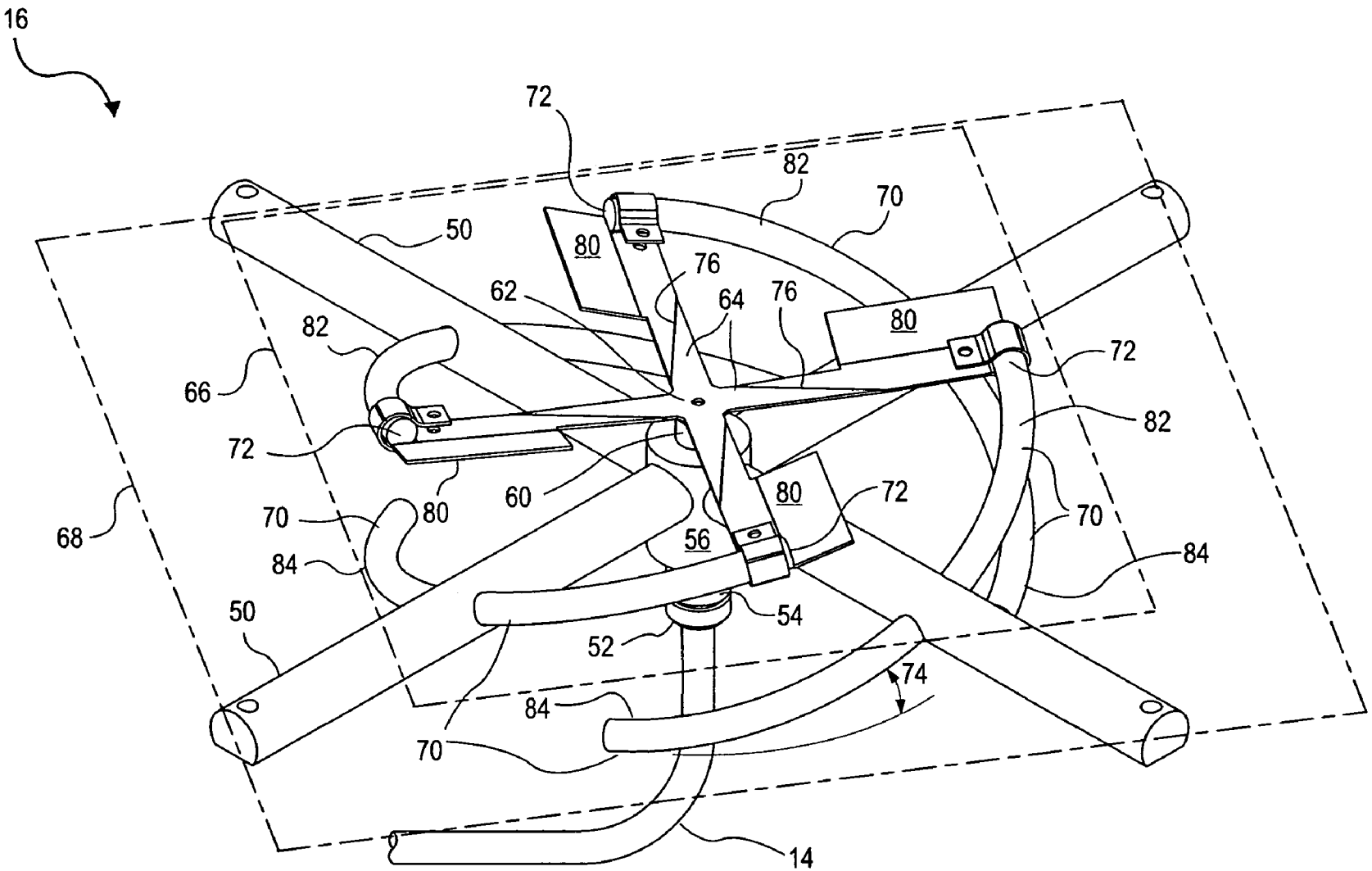
FIG. 2 is a perspective view of a single radiator of an antenna according to the present invention.

Use of fewer than four vertical support struts 36 has also been evaluated. For many embodiments other than the simple four-strut 36 configuration of FIG. 1, the radome 22 may be required to be at least self-supporting, and adding of loads above the antenna may be restricted. Depending on the cross section and strength of the support struts 36, use of fewer support struts 36 can result in a less rigid overall structure. Use of three conductive struts 36 at uniform intervals (120 degrees) is compatible with three-dipole configurations if it is desired to avoid pattern distortion that may result from having each of the struts 36 subjected to and interacting with a different field gradient. With two or four struts 36, each may be positioned in a substantially equivalent position in a four-dipole configuration, as shown in FIG. 2, discussed below.

The radome 22 shown in phantom in FIG. 1 may be a simple cylindrical segment of PVC construction pipe, with "small schedule"—i.e., thin wall—and suitable for prolonged exposure to daylight and weather—i.e., resistant to ultraviolet (UV) light, heat, cold, rain, ice, and typical pollutants. Comparable materials having acceptable structural integrity and extent of transparency to radio waves in the band of use may be preferred in some embodiments. The thin wall and cylindrical form of the radome 22 shown are advantageous for assuring low loss, low effect on azimuth uniformity, and inconspicuousness of the antenna 10, although other designs may also be used. The radome 22 can be attached to a top plate 42 above, and can be attached to, resting upon, or suspended above the antenna base 20 below. In such arrangements, if the top plate 42 is strongly attached to the vertical struts 36 as an upper terminus therefor, the antenna 10 may be capable of supporting significant mechanical loads, such as compression, bending, shear, and torque. The radome 22 may be sealed to a closed, substantially horizontal top plate 42 with one or more O-rings (not shown) within 0-ring grooves 44, for example, as shown in FIG. 1. In other embodiments, the radome 22 may use a sealant such as room temperature vulcanizing (RTV) adhesive (not shown) in lieu of O-rings and O-ring grooves 44 in the top plate 42. The radome 22 may be provided with drain cutouts 46 at the bottom, as shown in FIG. 1.

The base 20 provides attachment for the vertical struts 36, and further provides mounting ears 48 whereby the antenna 10 can be fixed to an external structure (not shown), such as a tower top, a building, or a lateral strut or base plate projecting from a structure. Many alternative mounting provisions are possible, such as a flare at the base 20 similar in appearance to the mounting ears 48 shown, but continuous around the base 20. Such a configuration may provide more attachment options.

In embodiments with a mechanically robust base 20, strut 36, cross member 38 and top plate 42 configuration, the radome 22 may have no more strength than is needed to perform one or more functions such as retaining shape under wind load, shielding against sun and ice over the anticipated product life, and facilitating sealing against water intrusion over anticipated climate conditions. In other embodiments, the radome 22 may be further required to be self-supporting, to perform a sealing function without aid from the support structure, or to provide at least some load bearing capability.

The antenna input shown in FIG. 1 is a short segment of coaxial line 24 terminated at a flange 30, with provision for pressurization. A typical embodiment can use an Electronic Industry Association (EIA) standard flange 30, welded or brazed to the input coax 24, with provisions for bolting to the broadcast transmission line 28 and sealing with an O-ring (not shown), for example. Various pressurization methods are known in the art for maintaining a transmission line 28 above atmospheric pressure and in a dry condition, at least in those parts of the line 28 that are exposed to weather, although other methods may also be used.

Each bay includes a single circularly-polarized radiator 16. Each radiator 16 emits an elliptically polarized signal that is substantially omnidirectional with respect to azimuth and toroidal with respect to elevation, with an axial ratio near unity at all azimuths—i.e., effectively circularly polarized. A limitation on azimuthal uniformity of axial ratio, namely the presence of conductive vertical struts 36, has been discussed. Strut 36 materials that are substantially nonconducting and low-loss may provide somewhat higher uniformity, particularly in the distribution of vertical signal strength with azimuth.

FIG. 2 shows a single radiator 16, including a multi-arm cross-brace 50 that forms a structural component of the radiator 16. The cross-brace 50 may be able to contribute radial mechanical strength sufficient to reduce tendencies for the peripherally-mounted vertical struts 36 and diagonal struts 38, shown in FIG. 1, to bow outward, twist, buckle, or otherwise deform or fail in response to mechanical loads. A coaxial feed line 14 from the power divider 12, shown in FIG. 1, is provided to each radiator 16. Each feed line 14 may terminate in a connector half 52 that mates with a corresponding connector half 54 on the radiator 16. In the embodiment shown, the feed line 14 terminates in a standard Type-N cable-end connector 52 (male center conductor, female-threaded outer conductor), and mates with a common Type-N threaded bulkhead-style connector body 54 (female center conductor, male-threaded outer conductor) that is screwed into the hub 56 of the radiator 16. The extended center conductor (not shown in FIG. 2) of the bulkhead connector opposite the connector 54 mating face is attached to a "mushroom," i.e., a terminating flange 60, that provides an attachment point to a single X-shaped feed strap 62, termed herein "manifold" in view of the plurality of radiating components whereto signal energy is coupled by the feed strap 62.

Four blades 64 of the feed strap 62 extend outward, lying approximately in a strap plane 66 generally parallel to the plane 68 of the structural brace 50 portion of the radiator 16, with the blades 64 directed toward upper extents of the radiative components, or dipoles 70, of the radiator 16. The ends of the blades 64 are formed to wrap around and make electrical contact at near-tip attachment points 72. The blades 64 in the embodiment shown are creased to broadly match the angle of advance 74 of the dipoles 70. The blades 64 tilt upward out of the strap plane 66 as a consequence of being creased. In some embodiments, such as those wherein the dipoles 70 differ from one another in length or in angle of advance 74, the form of the respective blades 64 may vary, such as by being non-orthogonal within the feed strap 62, having differing crease 76 locations or extent of bending, attaching to the respective dipoles 70 at differing distances along the respective dipoles 70, and the like. Such variations fall within the scope of the invention, although other configurations may also be used.

The blades 64 in the embodiment shown include conductive tuning paddles 80. The paddles 80 can be positioned radially (by design change) or in tilt (by bending) to adjust radiator 16 impedance. The shapes, dimensions, and orientations of the respective paddles 80 tune the radiators 16 as viewed at the input connector 54, while the paddles 80 emit negligible additional or spurious radiation in at least some embodiments. In particular, final settings of bandwidth, impedance, axial ratio, and like properties of each radiator 16 may be established by altering configuration of the paddles 80.

The four dipoles 70 in the embodiment shown are cast as a single part with the arms of the structural cross-brace 50 and with the associated hub 56. The upper monopoles 82 of the respective dipoles 70 extend about a quarter-wavelength from the braces 50, so that the overall combination of dimensions, along with load splitting by the manifold feed strap 62 to the near-tip attachment points 72 provides termination in a preferred impedance at the antenna 10 frequencies. The lower monopoles 84 are not separately excited, but function with the driven monopoles 82 to form dipoles 70.

Because of the geometry of the components, even a single one of the dipoles 70, driven as shown by a single blade 64, in the absence of the other three dipoles 70, will emit a circularly polarized signal. An opposed pair of dipoles 70 will also emit, and will exhibit greater pattern uniformity than the single. As discussed in *Antenna Engineering Handbook, Third Edition*, R. C. Johnson, ed., McGraw-Hill, 1993, section 28-3, "Circularly Polarized Antennas," herein incorporated by reference, a four-dipole shunt-fed helical radiator, similar to the quasi-helical radiator shown in FIG. 2, having uniform dipole lengths, helix angles, and feed points, may have a preferred circumference—in this instance the effective path length of a projection parallel to the antenna axis 34 of the dipoles 70 onto a plane 32 perpendicular to the axis 34 (see FIG. 1)—of about one wavelength. A three-dipole equivalent is preferably about three-fourths of a wavelength in circumference, while a two-dipole equivalent is preferably about one-half wavelength in circumference, and a one-dipole equivalent is preferably about one-quarter wavelength in circumference. An antenna configured according to the present invention and dimensioned approximately according to Johnson will behave similarly with respect to pattern, and may exhibit improved bandwidth.

Figure 3:
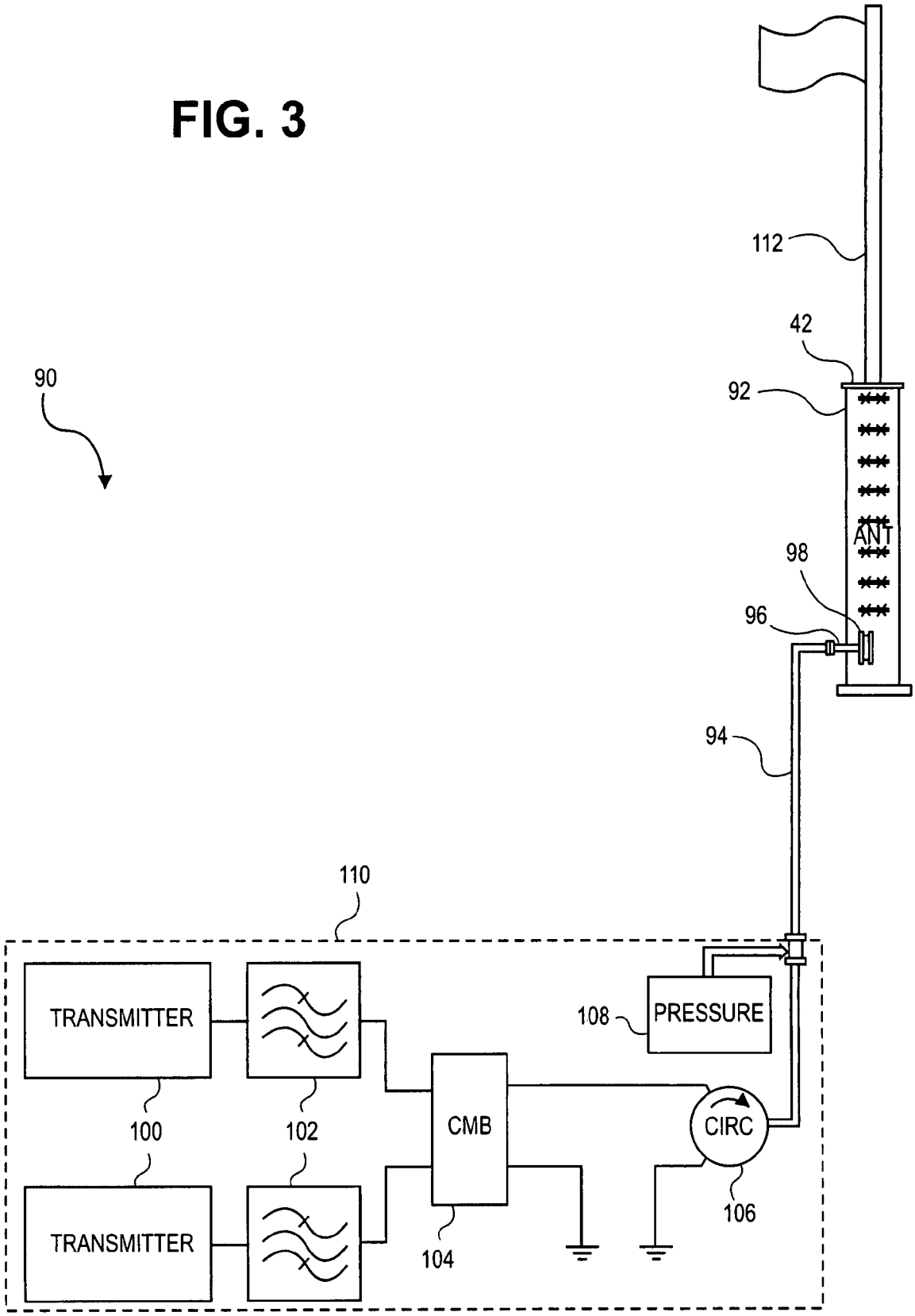
FIG. 3 is a schematic diagram of a signal broadcasting system incorporating an antenna according to the present invention.

The diagram in FIG. 3 shows in schematic form a more complete view of a system 90 of which an antenna 92 according to the present invention forms a part. In the embodiment shown in FIG. 3, an antenna 92 is fed from a coaxial line 94 that mates with the input feed line 96 of the power divider 98. The coaxial line 94 provides a signal from a transmitter or group of transmitters 100, and may be fed by way of output filters 102, combiners 104, circulators 106, pressurizing apparatus 108, and the like in some embodiments to form the transmitting system 90. The source apparatus 100, 102, 104, 106, 108 may be positioned within a transmitter house 110. The antenna 92 may be configured to bear a flagpole 112 or other external structural load; for such functions, the top plate 42, shown in FIG. 1, may accommodate mounting provisions of any appropriate type, such as blind threaded holes.

FIG. 4 shows a set of overlaid test plots 120 representing antenna signal strength versus azimuth for a prototype 8-bay antenna according to the present invention, wherein the vertical struts 36 of FIG. 1 are fabricated from a good conductor, such as structural steel. In keeping with conventional practice in the art for representing circularly polarized waveforms, the figure includes, as a first curve 122, a boundary limit for horizontally polarized signal strength, measured by orienting a linearly-polarized receiving antenna horizontally at far field and rotating the antenna under test about its vertical axis 34, shown in FIG. 1, through at least 360 degrees, while transmitting. FIG. 4 also illustrates, as a second curve 124, a boundary limit for vertically polarized signal strength, measured similarly, but with the linearly-polarized receiving antenna oriented vertically. A representation of circularly-polarized signal strength 126 at each azimuth, as developed by rotating the antenna under test at a low rate with respect to the receiving antenna, while the receiving antenna is rotated at a high rate about an axis radial to the antenna under test, is also shown.

The jagged appearance of the signal strength plot 126 is an artifact of the relative rotation rates. The greater the magnitude of the excursions, the greater the difference between vertical and horizontal signal magnitudes in the elliptical emission pattern as detected in the test procedure. This plot shows instantaneous voltage measurements as a radial distance from the center of the chart, roughly normalized, so doubling displacement from the center represents a 6 dB increase in signal strength. Using the horizontal 122 and vertical 124 plots, the worst-case voltage axial ratio is around 2 (6 dB) at 224 degrees and 320 degrees, and is generally highest at the intercardinal nodes, here located around 45, 135, 225, and 315 degrees referenced to the chart. The axial ratio decreases to unity at several azimuths, and has a greater vertical component 124 over some azimuths.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A broadcast antenna, comprising:

a structural support base;

a support structure comprising a plurality of substantially vertical struts, uniformly distributed about a central vertical axis of the antenna, wherein each of the vertical struts extends upward from a point of attachment to the base;

a first substantially horizontal cross-brace that interconnects the vertical struts at a first elevation above the support base; and a first single-feed radiator, substantially omnidirectional with respect to azimuth, that radiates an elliptically polarized signal, wherein the first radiator is structurally integral with the first cross-brace, and resides physically within a prismatic volume that encloses the horizontal extent of the support structure.

2. The broadcast antenna of claim 1, wherein the vertical struts are conductive.

3. The broadcast antenna of claim 1, wherein the vertical struts are nonconductive.

4. The broadcast antenna of claim 1, further comprising a radome that surrounds at least the first radiator and such parts of the vertical struts as are proximal thereto, wherein the radome is substantially transparent to the broadcast signal energy of the antenna, and wherein the radome provides a substantially impervious barrier to air flow, water penetration, and access by airborne particulate matter to the first radiator over the volume enclosed by the radome.

5. The broadcast antenna of claim 4, further comprising a top structural fixture, wherein the top structural fixture provides an upper terminus for the vertical struts of the support structure, wherein the top structural fixture comprises a closed, effectively horizontal upper surface, and wherein a joint between the radome and the top structural fixture comprises a weather-tight seal.

6. The broadcast antenna of claim 1, wherein the first radiator further comprises at least one conductive rod joined to the first cross-brace proximal to a midpoint of a longest dimension of the rod, wherein the at least one rod is on the order of a half-wavelength in physical length, and is substantially arcuate in form, and wherein the arc of the at least one rod falls along a quasi-helical path at a substantially constant distance from the central vertical axis of the antenna.

7. The broadcast antenna of claim 6, wherein the first radiator further comprises substantially similar conductive rods totaling three rods, wherein the respective rods are oriented with threefold rotational symmetry about the central vertical axis of the antenna.

8. The broadcast antenna of claim 6, wherein the first radiator further comprises substantially similar conductive rods totaling four rods, wherein the four rods comprise four dipoles, oriented with fourfold rotational symmetry about the vertical axis of the antenna, wherein the rods are so configured as to establish a principal frequency within a frequency band.

9. The broadcast antenna of claim 6, wherein the first radiator further comprises a second conductive rod substantially identical to the first conductive rod, wherein the first two rods are oriented with twofold rotational symmetry about the central vertical axis of the antenna.

10. The broadcast antenna of claim 9, wherein the first radiator further comprises a second two arcuate, helically-disposed conductive rods, substantially identical to one another, wherein the second two rods are oriented with rotational symmetry about the central vertical axis of the antenna and are interstitially positioned with respect to the first two rods, wherein the length, quasi-helical angle of advance, and distance from the vertical axis of the antenna of the second two rods are independent of the corresponding dimensions of the first two rods.

11. The broadcast antenna of claim 6, wherein the first radiator further comprises:

a central hub wherefrom a plurality of structural parts that the first cross-brace comprises extend to attachment points with the plurality of vertical struts;

a central coaxial connector, comprising an outer conductor conductively joined to the central hub proximal to a connecting locus of the outer conductor, and an inner conductor that passes through the hub, having a connection locus coincident with the connecting locus of the outer conductor;

a central terminating flange connected to the central coaxial connector inner conductor distal to the connecting locus thereof; and a manifold feed strap connected to the terminating flange at a central node of the feed strap, and connected to at least one rod of the first radiator proximal to a single end of the at least one rod.

12. The broadcast antenna of claim 11, wherein the at least one rod further comprises a dipole whereof rod length, quasi-helical angle of advance, and feed strap connection location establish a principal frequency within a selected frequency band.

13. The broadcast antenna of claim 11, wherein the manifold feed strap further comprises a tuning paddle positioned between the hub and the connection of the feed strap to the at least one rod.

14. The broadcast antenna of claim 11, wherein the central hub, the structural parts that the cross-brace comprises, and the at least one rod that the first radiator comprises are formed into a single conductive unit by a forming process, wherein the forming process is casting, molding, forging, metal joining, solid freeform fabrication, pressing, machining, a combination of these processes, or another process.

15. The broadcast antenna of claim 11, wherein the central hub, the structural parts that the cross-brace comprises, and the at least one rod that the first radiator comprises are formed into a single unit by a forming process, wherein the forming process comprises forming the single unit and applying a conductive coating over the material so formed at least in part.

16. The broadcast antenna of claim 6, further comprising a plurality of radiators substantially identical to the first radiator, wherein each of the radiators occupies a discrete vertical position, termed a bay, and wherein the bays are substantially uniformly spaced.

17. The broadcast antenna of claim 16, further comprising:

a passive power splitter, wherein the power splitter accepts a broadcast-level signal as input and produces a plurality of feed source signals as outputs, wherein the outputs are substantially equal to one another in phase, power, and spectral content, and differ from the input signal in power and phase;

a plurality of feed lines, wherein each feed line of the plurality of feed lines is a coaxial line configured to carry a feed source signal having frequency and power characteristics of a broadcast signal, wherein each feed line couples a signal from the power splitter to one of the radiators, and wherein the feed line lengths either are substantially equal or are unequal to an extent selected to provide a specified amount of at least one of beam tilt and null fill.

18. The broadcast antenna of claim 16, wherein the vertical bay spacing is a function of the frequency band of the antenna, the number of bays whereof the antenna is comprised, and a requirement for a vertical null in radiative emission.

19. The broadcast antenna of claim 18, wherein the vertical bay spacing approximates lambda*(n−1)/n, for lambda equal to the wavelength of a frequency associated with the frequency band of the antenna, and for n equal to the number of bays of the antenna.

20. A broadcast antenna, comprising:

means for supporting an antenna from a base position;

means for sustaining a mechanical load applied to a top position;

means for sustaining vertically-applied compression and tension loads and laterally applied bending, torque, and shear loads at a plurality of locations uniformly distributed around a central vertical axis of the antenna;

means for maintaining substantially constant spacing between the distributed means for sustaining loads;

means for radiating a broadcast signal having elliptical polarization substantially invariant with azimuth from a location congruent with the means for maintaining spacing; and means for barring air flow, water penetration, and access by airborne particulate matter from the means for radiating, at least in part.

21. The broadcast antenna of claim 20, further comprising means for distributing an applied signal to a plurality of means for radiating, wherein the plurality of means for radiating are distributed at substantially equal vertical intervals, wherein the plurality of means for radiating emit substantially equal signals, and wherein a far-field signal measurement to sense output of the broadcast antenna exhibits substantial uniformity of distribution of signal strength with azimuth, exhibits gain that depends in part on the number of discrete means for radiating in the broadcast antenna, exhibits nearness of axial ratio to unity that depends in part on azimuth with respect to the plurality of means for sustaining vertical loads, and exhibits a substantial vertical null.

22. A method for broadcasting electromagnetic signals, comprising:

accepting at least one broadcast-level signal having a bandwidth extent and a power level that fall within a prescribed range;

dividing the accepted signal into a plurality of individual signals, wherein the respective individual signals have frequency spectra substantially identical to the accepted signal, and wherein the respective individual signals have substantially identical phase and signal strength;

applying the respective individual signals to a plurality of broadband radiative devices that each radiate with elliptical polarization and substantial azimuthal omnidirectionality, wherein the respective radiative devices are integral with cross-bracing structures, wherein each of the respective radiative devices includes a plurality of quasi-helically-disposed, conductive, arcuate rods operable to radiate in a common frequency band, arranged with approximate n-fold rotational symmetry, where n is the number of rods included in a radiative device, wherein the respective rods are joined to the cross-bracing structures at respective rod midpoints, and wherein the signals applied to the respective radiative devices are so coupled to the respective rods as to radiate therefrom with substantially uniform phase;

providing vertical load bearing capability, from a locus above the topmost radiative device to a locus below the bottommost radiative device, sufficient to support not less than the full weight of and climatic load applied to the structure, wherein all radiative devices rest within an envelope whereof edge boundaries are established by structures providing vertical load bearing;

providing junction between the cross-bracing structures and the load bearing structures, wherein mechanical interaction therebetween is sufficient to reduce tendencies for the load bearing structures to deform under load; and providing weather shielding, wherein a weather protective enclosure includes at least a tubular sleeve of substantially continuous, cylindrical, nonconductive material, external to the load bearing and radiative components.

23. The method for broadcasting electromagnetic signals of claim 22, further comprising establishing tuned terminations of the individual signals on a plurality of manifold feed straps for the plurality of radiative elements, wherein the termination tuning includes a plurality of conductive tuning paddles, positioned on a plurality of blades on each respective manifold feed strap, coupling individual signals radially to the respective arcuate rods, wherein the tuning paddles are impedance lumps positioned between common points of the blades on the respective feed straps and points of coupling between the blades and the respective arcuate rods.

* * * * *